US005205724A

United States Patent [19]

Alexander

[11] Patent Number: 5,205,724

[45] Date of Patent: Apr. 27, 1993

[54] REVOLVING PISTON COMPRESSOR

[76] Inventor: Esteban T. Alexander, Calle J. No. 1, Unidad Alianza Revolucionaria, Coyoacan, D.F., C.P. 04800, Mexico

[21] Appl. No.: 815,953

[22] Filed: Dec. 31, 1991

[30] Foreign Application Priority Data

Jul. 23, 1991 [MX] Mexico ..... 9100336

[51] Int. Cl.[5] ..... F04B 17/00; F01C 3/02

[52] U.S. Cl. ..... 417/420; 418/207; 418/195

[58] Field of Search ..... 417/420; 418/207, 195, 418/226, 227

[56] References Cited

U.S. PATENT DOCUMENTS

| | | | |
|---|---|---|---|
| 822,952 | 6/1906 | Jewell | 418/195 |
| 928,506 | 7/1909 | Driggs | 418/195 |
| 1,159,554 | 11/1915 | Veley | 417/362 |
| 1,307,210 | 6/1919 | Newcomb | 417/420 |
| 4,506,522 | 3/1985 | Swaney | 417/362 |
| 5,017,102 | 5/1991 | Shimaguchi | 417/420 |

*Primary Examiner*—John J. Vrablik
*Assistant Examiner*—Roland McAndrews
*Attorney, Agent, or Firm*—Dvorak and Traub

[57] ABSTRACT

Revolving piston compressor, which consists of two hollow rings when joined, form a tunnel or "sleeve" within which a curved piston circulates. A transversely disposed disc turns in synchronized fashion with the piston to form a wall which prevents the gas acted upon by the piston from travelling around through the sleeve. As the piston approaches the disc, the disc presents a "window", which allows the piston to pass. Once the piston has passed, the disc again forms a wall, closing the compression cycle. Because the piston cannot be physically engaged from the outside, it is moved via a moving magnet.

9 Claims, 6 Drawing Sheets

REVOLVING PISTON COMPRESSOR

BACKGROUND OF THE INVENTION

Present compressors can be classified as follows: 1) piston (or reciprocating) compressors; 2) sliding blade compressors; 3) lobe compressors and 4) turbine (or radial flow) compressors.

Piston compressors. This type consists essentially of one or more pistons that run the interior of a hollow cylinder or sleeve in a reciprocating movement. Their operation is similar to that of a hypodermic syringe. These compressors are suitable where high pressures are required. Their theoretical maximum yield is 65%, and they can function up to ten thousand hours without requiring a general adjustment.

Sliding blade compressors. This type consists essentially of a hollow cylinder inside which another cylinder, containing several sliding blades placed radially, turns. Because the inside cylinder is disposed eccentrically with respect to the outside cylinder, the centrifugal force urges the sliding blades to describe an ellipse. The blades, in passing, compress the air, since the distance between the interior and the exterior cylinders diminishes. These compressors are suitable where large volumes of compressed air are required, at a relatively low pressure (6 or 7 atmospheres). These machines can function up to fifty thousand hours without needing major adjustments, and their maximum theoretical yield is 90%.

Lobe compressors. This type consists essentially of two or more rotors provided with synchronized lobes that turn inside a hollow cylinder. These compressors are suitable where large amounts of air are required at low pressures (maximum two atmospheres). Their yield is less than that of sliding blade compressors, but greater than that of piston compressors. Due to the eccentricity of the axes and the need for perfect synchronization between them, the mechanism easily loses adjustment, and therefore must be examined and adjusted frequently. One variation, known as a hydraulic piston type compressor, comprises a compressor piston (which is actually a lobe) comprising a bag full of oil, and is provided with blades. Upon turning, it follows the contours of a hollow cylinder whose interior is slightly oval. Because this compressor is not very reliable, and requires frequent maintenance, its use is highly restricted.

Turbine compressor. This type consists essentially of revolving elements (buckets) disposed in different radial positions along a single shaft. The shaft turns inside a long hollow cylinder, which has an inlet opening and an outlet opening. These compressors produce large volumes of air, but at a relatively low pressure (less than two atmospheres). The yield of this compressor is approximately 90%, and it can function up to sixty thousand hours without maintenance.

Revolving piston compressor. Because it is a revolving machine, it does not have appreciable kinetic losses. Therefore, its maximum theoretical yield is 90%. Its manufacturing cost is approximately one-third that of the sliding blade compressor, and approximately one-half that of the turbine compressor. This machine can reach pressures almost as high as those obtained with piston compressors, but with a higher yield. Its manufacturing cost is comparable to that of a reciprocating compressor having a similar volume flow rate capacity. In the revolving piston compressor, the entire cycle of the piston involves compression, as compared to traditional piston compressors, where one stroke is intake and the other compression.

As can be seen, this new revolving piston compressor has the advantages of both reciprocating compressors (high pressures and ease of construction) and revolving compressors (high yield, little maintenance and long duration). In addition, because the kinetic losses do not increase with the speed of the piston (as occurs with reciprocating compressors), the number of R.P.M. is not restricted, and, therefore a relatively small size machine can compress large volumes of air.

DETAILED DESCRIPTION OF THE PREFERRED EMBODIMENT

Figure 4:
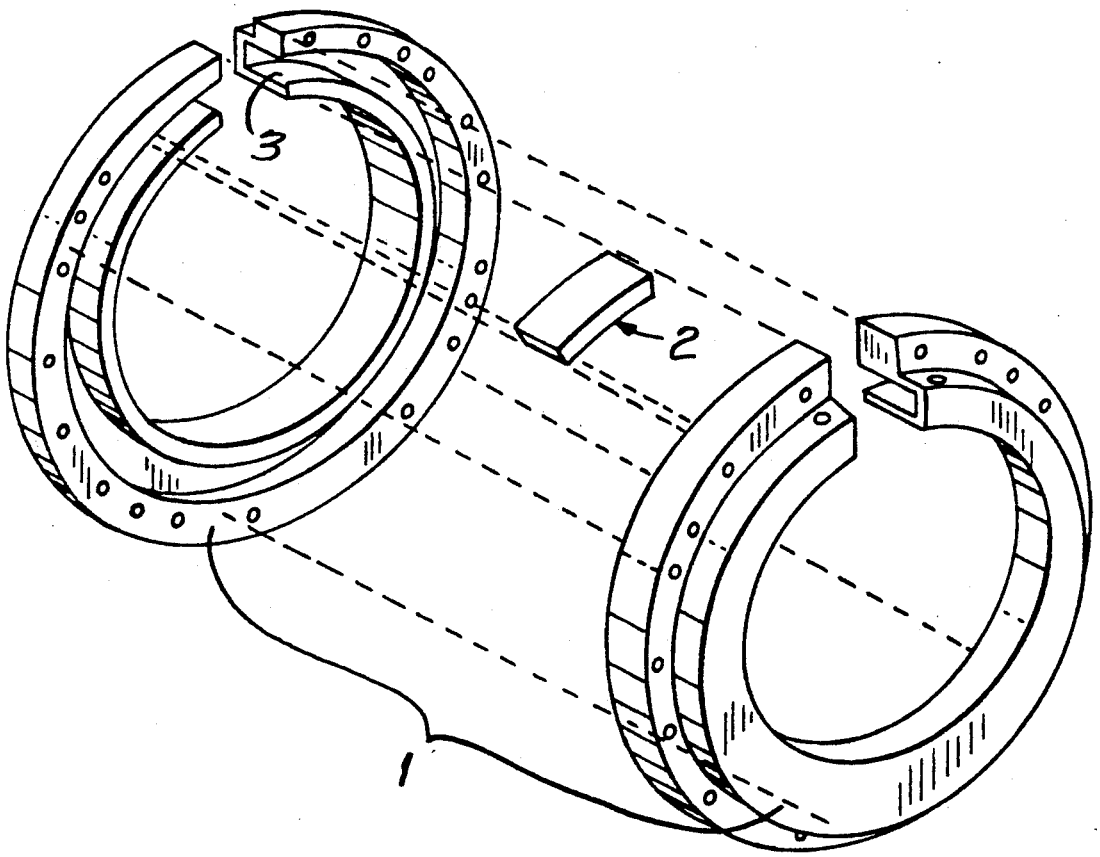
FIG. 4 is an exploded perspective view of the ring and piston assembly.
Figure 6:
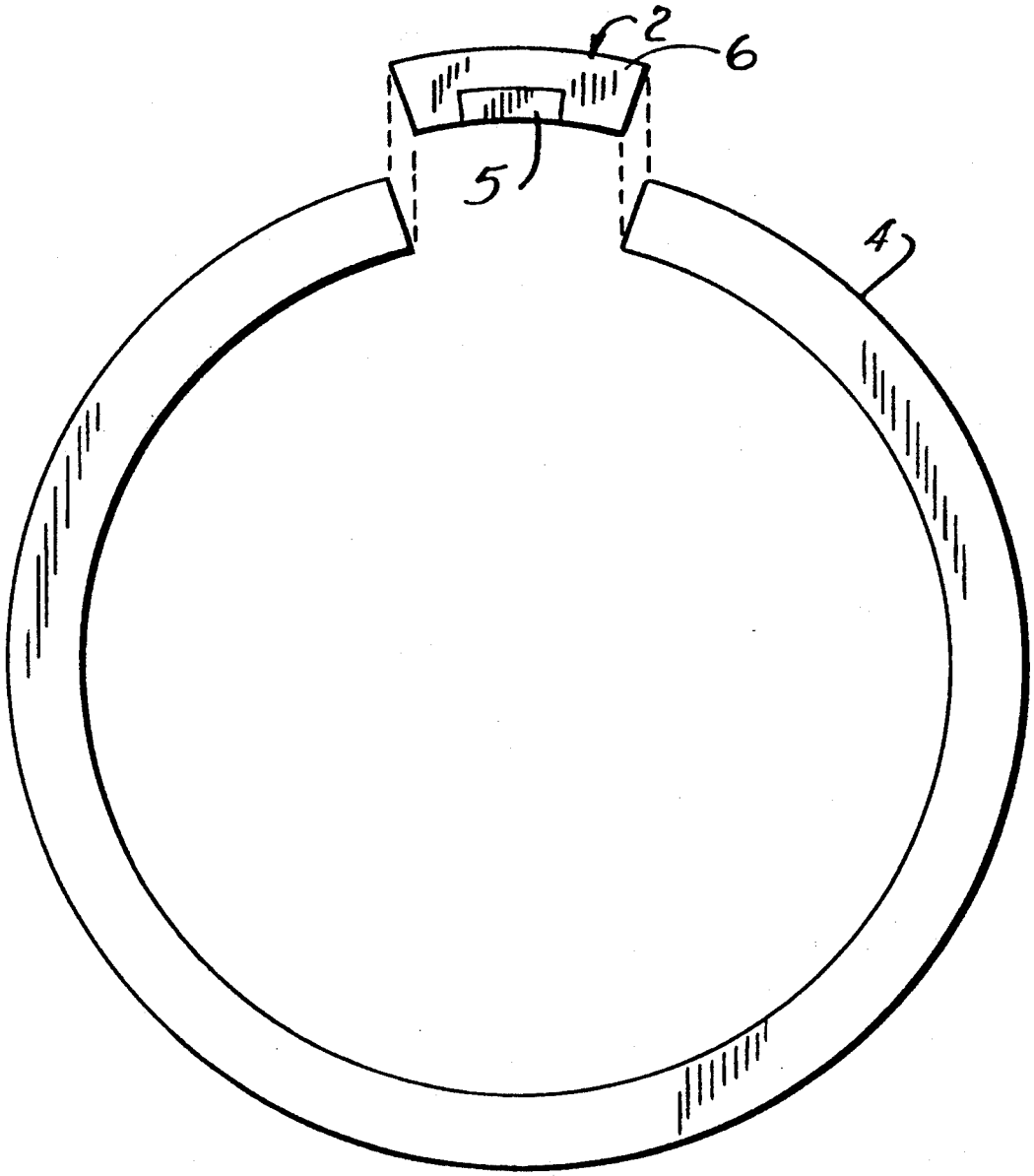
FIG. 6 is a side elevation view of the piston.

As can be seen in FIG. 4, the body of the compressor is formed by two hollow rings 1, which, when joined on the ridge with fasteners or other means, form a tunnel 3 in the way of a sleeve, through which a curved piston 2 turns. In the prototype test apparatus, the rings are made of bronze. However, stainless steel 304 or other antimagnetic material could be used instead. The revolving piston of FIGS. 4 and 6 may be obtained by cutting a section of a complete cold rolled 1010 steel ring 4, having dimensions slightly less than those of the tunnel 3 formed by the hollow bronze rings.

In one embodiment, the piston measures 6 centimeters in length. On the central lower part it has a bronze branch 5 (which could also be of any other antimagnetic material) forming an inverted "U shaped portion 6". The purpose of this is to present two protuberances with dimensions equal to those of the poles of a magnet that propels the piston 2.

Figure 1:
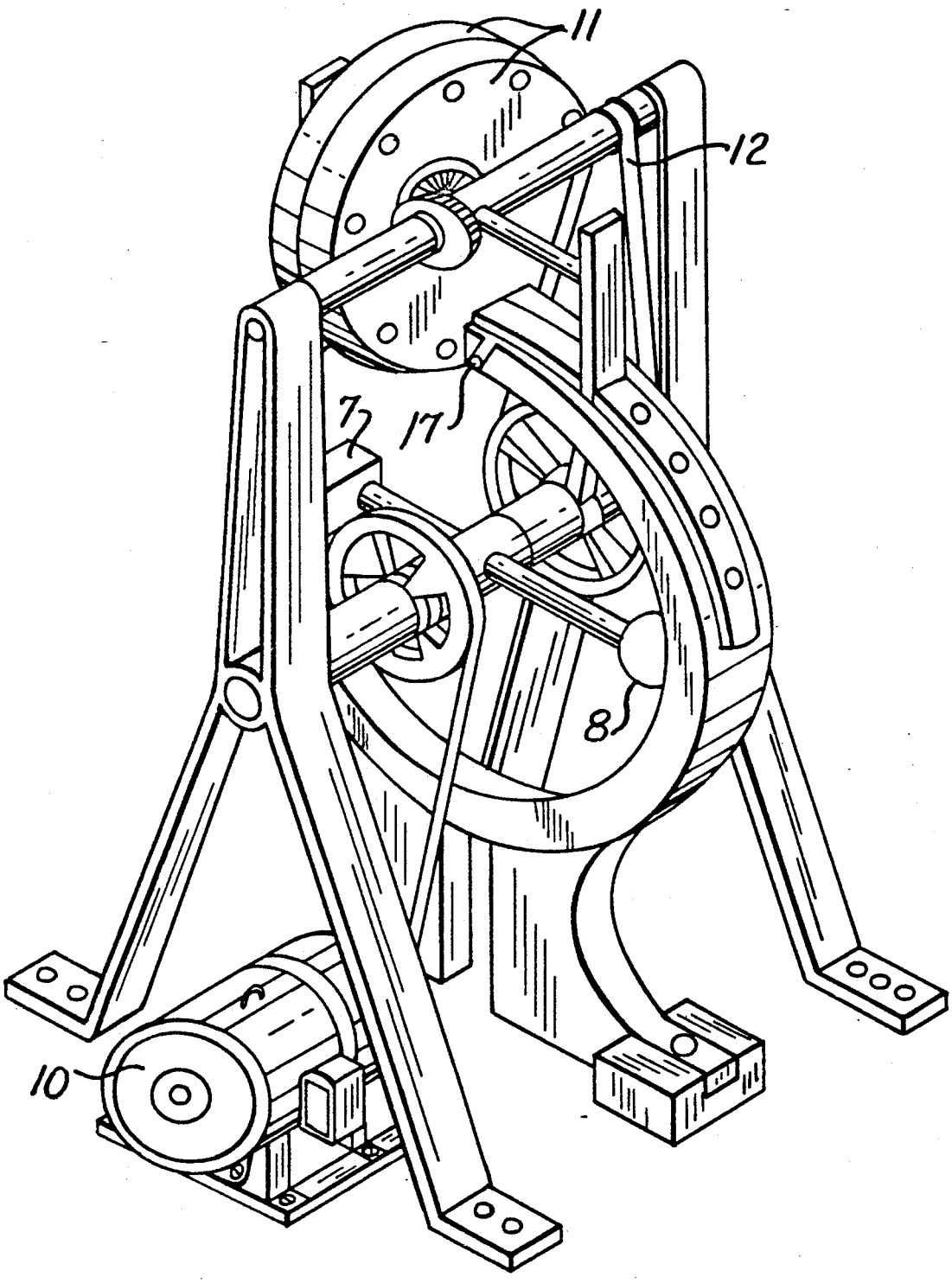
FIG. 1 is a perspective view of the apparatus of the claimed invention.
Figure 2:
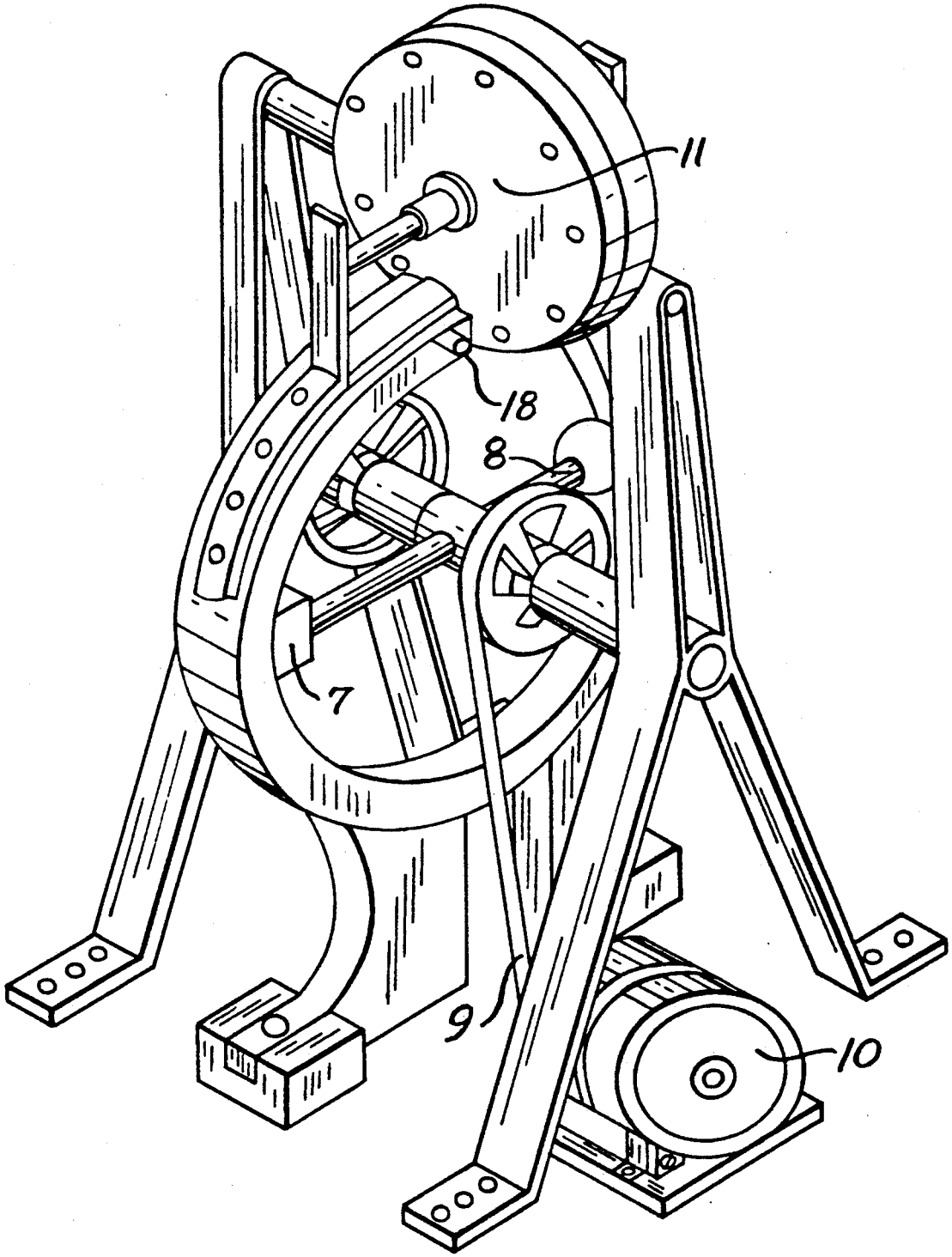
FIG. 2 is a second perspective view of the apparatus of the claimed invention.
Figure 3:
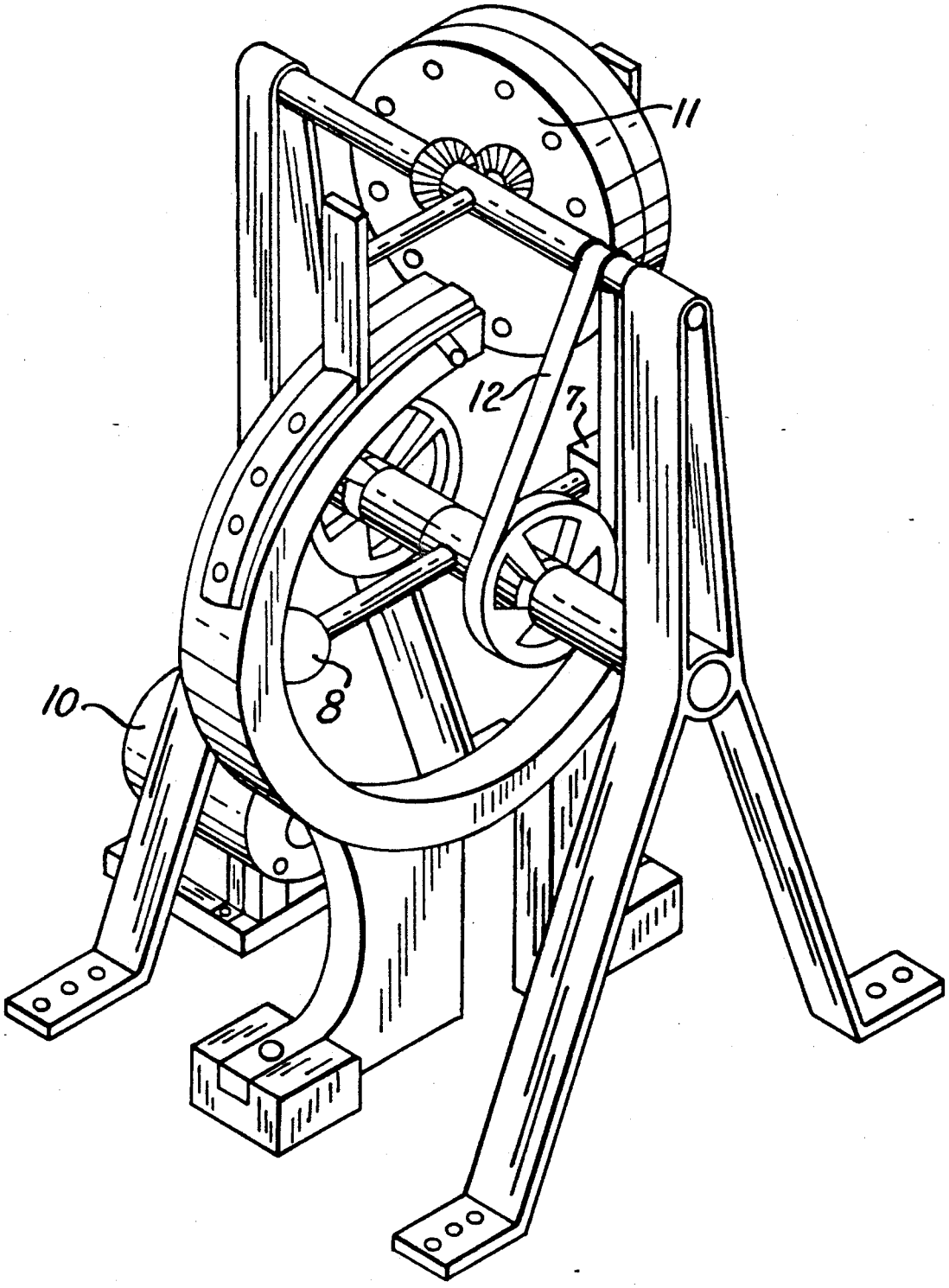
FIG. 3 is a third perspective view of the apparatus of the claimed invention.

Referring now to FIGS. 1, 2 and 3 holes drilled in the ridge of the hollow bronze rings 1 serve to fasten them to a base via bronze feet, and to fasten the axle of the transverse gate.

In one embodiment, the magnet that propels the piston 2 around the ring is made of a neodymium plate and two cold rolled 1010 iron plates. The magnet is disposed inside a bronze box 7, and is seated on a bucket made of stainless steel, bronze, or other antimagnetic material. The box 7 containing the magnet, together with a counterweight 8, is rotated by an axle connected by a pulley 9 to an electric engine 10. The magnet may have a magnetic field on the order of 25 million gauss oersted.

Both the axle of the magnet and the axle that transmits movement to a gate 11 rest on two iron columns provided with two bearings each. The belt or pulley 9 that transmits movement from the engine 10 to the axle of the magnet is a standard type, while the belt 12 that transmits movement to the upper axle is toothed, for reasons of synchronization.

Figure 5:
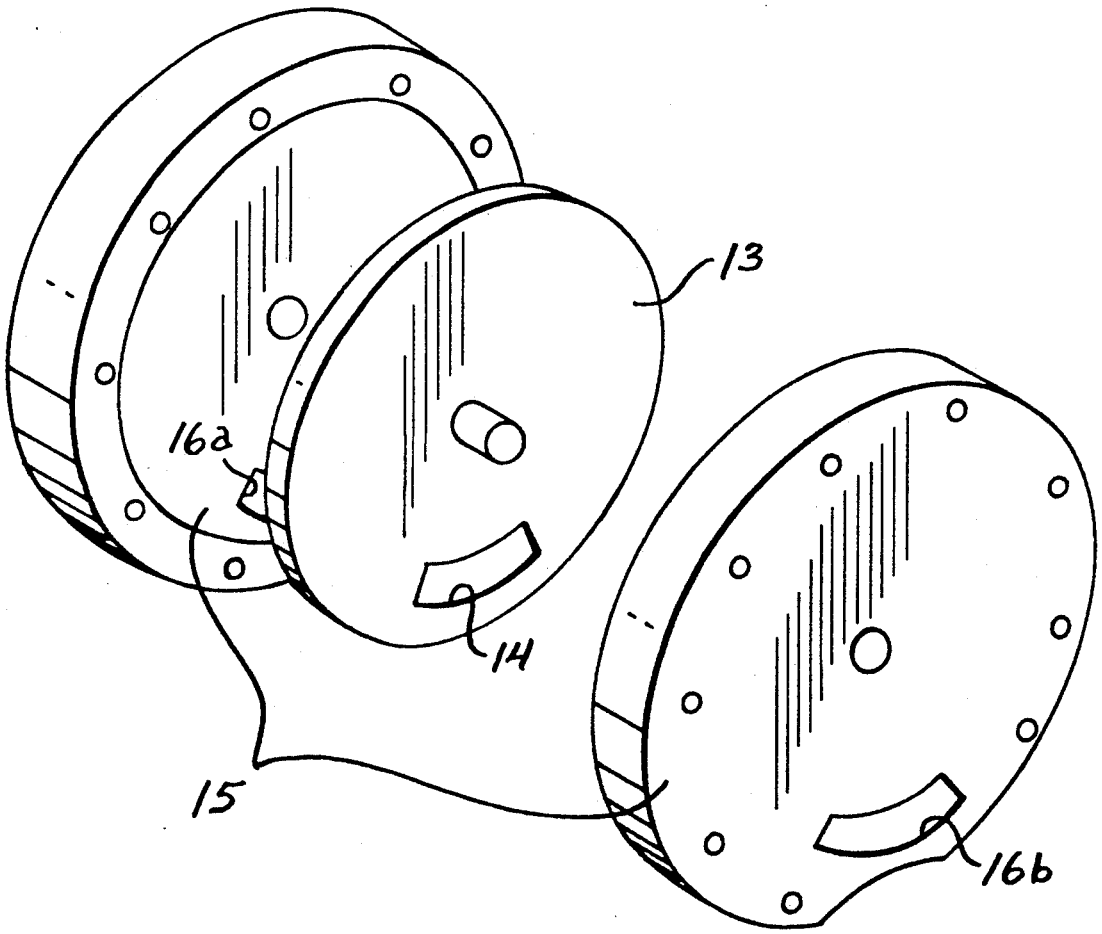
FIG. 5 is an exploded perspective view of the stainless steel of the gate assembly.

The gate 11 (see FIGS. 2 and 5) is situated transversely on the upper part of the machine. This gate 11 is fitted together with the hollow bronze rings. The gate 11 may occupy a 14 mm section, formed for this purpose. The gate consists of three pieces: a stainless steel disc 13 provided with a window 14 for passage of the piston, and two bronze caps 15 that on joining form a box that hermetically encloses the stainless steel disc.

The bronze caps 15 of the gate 11 are fastened with guys to the hollow bronze rings. These caps also have windows or parts 16*a* and 16*b* in the lower part, forming a tunnel through which the piston 2 circulates. The stainless steel disc 13 is provided with a hollow bucket of the same material, and freely revolves inside the box on an axle fastened by two support arms attached to the hollow bronze rings.

The piston 2 and the gate revolve in synchronized fashion, so that when the piston approaches the upper part of the sleeve, the window 14 of the stainless steel disc 13 allows passage. Once the piston has passed, the turn of the disc 13 blocks the sleeve again.

In the interior of the gate 11, near the bucket of the stainless steel disc, there are two sealing rings that prevent the compressed air from escaping to the outside. Air that escapes through the edges of disc 13 simply passes to the other side of the sleeve, but does not exit to the outside of the machine, and therefore is not wasted.

In the test apparatus, the piston 2, viewed from the engine side, turns clockwise. The admission valve 17 is approximately two centimeters to the right of the gate, while the injection valve 18 is approximately two centimeters to the left of this gate. When the piston is propelled by the magnet, it begins to compress the air trapped in the tunnel, or sleeve. Because the stainless steel disc is temporarily blocking the tunnel, the air is obligated to exit by the injection valve. When the piston approaches the gate, the window of the stainless steel disc opens, allowing the piston to pass. After the piston passes, as the ring continues turning, the tunnel is again blocked, completing the cycle. At the time the window of the stainless steel disc unblocks the tunnel, the compressed air that did not manage to leave by the injection valve goes to the other side of the gate, but does not exit, since the inlet valve 15 allows the entrance of air, but not its exit. The compressor can be manufactured in different sizes and according to differing needs. Different cooling systems can be adapted to it that does not diminish its ability to function.

In connection with the foregoing description of this invention, the following is claimed:

1. A revolving piston compressor comprising:

a compression chamber having an open-ended non-magnetic annular sleeve for receiving a magnetically reactive piston;

a piston driver having a magnet disposed on a radial arm rotating about a central geometric axis of said annular sleeve wherein said magnet interacts with said piston thereby propelling said piston through said annular sleeve;

a transverse gate having a non-magnetic chamber, a non-magnetic rotating disc disposed in said non-magnetic chamber, said non-magnetic chamber having opposing gate ports interconnecting said non-magnetic chamber to said open ends of said annular sleeve, said rotating disc having a window therethrough wherein said rotating disc interposed said annular sleeve and wherein said window may be aligned with said opposing gate ports;

means for rotating said piston driver and said rotating disc;

means for synchronizing the position of said rotating disc and said piston driver relative to said annular sleeve thereby allowing said piston to pass through said window in said rotating disc;

whereby said piston creates a pressure gradient in said compression chamber.

2. A revolving piston compressor as claimed in claim 1, wherein said non-magnetic annular sleeve comprises two adjoining hollow rings and said non-magnetic chamber comprises two adjoining caps.

3. A revolving piston compressor as claimed in claim 1, wherein said piston driver magnet comprises a neodymium plate and at least one cold rolled iron plate.

4. A revolving piston compressor as claimed in claim 1, wherein said means for rotating said piston driver is a belt, and said means for rotating said disc is a toothed synchronizing belt.

5. A revolving piston compressor as claimed in claim 1, wherein said annular sleeve and said non-magnetic chamber are bronze and said rotating disc is stainless steel.

6. A revolving piston compressor as claimed in claim 1, further comprising:

an air outlet port proximate one side of said transverse gate whereby said outlet port vents high pressure air created in a decreasing volume of said annular sleeve between said rotating disc interposing said annular sleeve and said accelerating piston; and an air inlet port proximate an opposing side of said transverse gate whereby said inlet port supplies air to a low pressure region created in an increasing volume of said annular sleeve between said rotating disc interposing said annular sleeve and said accelerating piston.

7. A revolving piston compressor as claimed in claim 6, further comprising:

a first axle connected to said radial arm and rotating about said central geometric axis of said annular sleeve;

a second axle connected to said rotating disc and rotating about a central geometric axis of said rotating disc;

a differential interconnecting said first and said second axles; and an electric motor connected to said first axle.

8. A revolving piston compressor as claimed in claim 1, wherein said magnetically reactive piston has a non-magnetic portion resulting in a U-shaped magnetically reactive portion.

9. A revolving piston compressor as claimed in claim 8, wherein said piston comprises a cut section of a cold rolled steel ring having dimensions complementary to said annular sleeve.

* * * * *